US012305645B2

(12) United States Patent
Rosinski et al.

(10) Patent No.: US 12,305,645 B2
(45) **Date of Patent: *May 20, 2025**

(54) THERMISTOR FLOW PATH

(71) Applicant: GHSP, Inc., Holland, MI (US)

(72) Inventors: Ryan David Rosinski, Whitehall, MI (US); Bradley John Vecellio, Spring Lake, MI (US)

(73) Assignee: GHSP, Inc., Holland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/603,692

(22) Filed: Mar. 13, 2024

(65) Prior Publication Data

US 2024/0218872 A1 Jul. 4, 2024

Related U.S. Application Data

(63) Continuation of application No. 17/544,215, filed on Dec. 7, 2021, now Pat. No. 11,959,481, which is a (Continued)

(51) Int. Cl.
*F04C 2/10* (2006.01)
*F04C 15/00* (2006.01)

(Continued)

(52) U.S. Cl.
CPC ..... *F04C 2/102* (2013.01); *F04C 15/0096* (2013.01); *F04C 29/045* (2013.01);

(Continued)

(58) Field of Classification Search
CPC .... F04C 15/0096; F04C 29/04; F04C 29/047; F04C 29/045; F04C 2/102; F04C 13/0646;

(Continued)

(56) References Cited

U.S. PATENT DOCUMENTS 2,939,399 A * 6/1960 Rutschi ..... F04D 13/06 417/357
3,220,350 A * 11/1965 White ..... F04D 13/0613 417/357

(Continued)

OTHER PUBLICATIONS pumpschool.com, published 2014, URL: https://web.archive.org/web/20140217213654/http://www.pumpschool.com/principles/gerotor.asp).

*Primary Examiner* — Christopher S Bobish
(74) *Attorney, Agent, or Firm* — Price Heneveld LLP

(57) ABSTRACT

A fluid pump includes a pump element where rotation of the pump element generates suction at the inlet and pressure at the outlet to move fluid through a fluid path. An inlet orifice directs a portion of the fluid through the accessory fluid path that includes a low-restriction return path providing a continuous flow of the fluid through the accessory fluid path and to an outlet orifice. A circuit board housing includes a contoured portion and a PCB with a thermistor in communication with contoured portion. The continuous flow is directed between the contoured portion and the outlet orifice between a rotor and the outer wall. The low-restriction return path maintains a temperature of the continuous flow of the fluid within the contoured portion of the accessory fluid path to be similar to a temperature of the fluid in the fluid path.

20 Claims, 14 Drawing Sheets

Related U.S. Application Data continuation-in-part of application No. 17/141,265, filed on Jan. 5, 2021, now Pat. No. 11,454,235, which is a continuation of application No. 15/590,248, filed on May 9, 2017, now Pat. No. 10,914,305.

(60) Provisional application No. 62/342,615, filed on May 27, 2016.

(51) Int. Cl.
*F04C 29/04* (2006.01)
*F04D 13/06* (2006.01)
*F04D 29/58* (2006.01)

(52) U.S. Cl.
CPC ..... *F04C 29/047* (2013.01); *F04D 13/0646* (2013.01); *F04D 13/0653* (2013.01); *F04D 29/58* (2013.01); *F04D 29/5806* (2013.01); *F04D 29/5813* (2013.01); *F04D 29/588* (2013.01)

(58) Field of Classification Search
CPC ..... F04C 13/0653; F04C 29/5806; F04C 29/5813; F04C 29/588; F04C 29/58
See application file for complete search history.

(56) References Cited

U.S. PATENT DOCUMENTS

RE26,438 E * 8/1968 White ..... F04D 13/0613 417/357
4,642,614 A 2/1987 Cook
4,652,218 A * 3/1987 Tsutsui ..... F04D 13/064 417/370
5,009,578 A * 4/1991 Hyland ..... F04D 29/0416 417/370
5,044,896 A * 9/1991 Genster ..... H02K 5/128 417/370
5,129,795 A * 7/1992 Hyland ..... H02K 7/09 417/423.12
5,151,016 A * 9/1992 Her ..... F04D 15/0218 417/372
5,322,421 A * 6/1994 Hansen ..... F04C 15/0096 417/420
5,725,362 A * 3/1998 Zepp ..... F04C 15/0096 417/366
5,882,182 A * 3/1999 Kato ..... H02K 9/197 417/366
5,939,813 A * 8/1999 Schob ..... F04D 29/041 310/90
5,949,171 A * 9/1999 Horski ..... F04D 13/064 310/43
5,997,261 A * 12/1999 Kershaw ..... F04D 29/5813 417/357
5,997,264 A * 12/1999 Klein ..... F04D 29/061 418/176
6,111,334 A * 8/2000 Horski ..... H02K 1/02 310/216.057
6,174,143 B1 * 1/2001 Horski ..... H02K 9/19 417/366
6,447,269 B1 * 9/2002 Rexroth ..... F04D 29/588 417/370
6,814,549 B2 * 11/2004 Kimberlin ..... F04C 23/008 310/90
6,837,688 B2 * 1/2005 Kimberlin ..... F04D 13/064 417/44.1
6,847,140 B2 * 1/2005 Kimberlin ..... F04D 13/064 310/86
6,857,140 B1 2/2005 Broudy
6,861,777 B2 * 3/2005 Kimberlin ..... F04C 15/0096 310/87
6,884,043 B2 * 4/2005 Kimberlin ..... F04C 14/06 417/357
6,986,648 B2 * 1/2006 Williams ..... F04D 13/064 417/370
7,081,728 B2 * 7/2006 Kemp ..... H02P 27/16 417/228
7,927,079 B2 * 4/2011 Suzuki ..... F04C 11/008 318/400.11
8,038,423 B2 * 10/2011 Nakayoshi ..... F04C 15/0026 418/171
8,872,396 B2 * 10/2014 Sakata ..... H02K 1/278 310/156.31
9,163,635 B2 * 10/2015 Chiu ..... F04D 13/0606
9,273,598 B2 3/2016 An et al.
9,587,647 B2 * 3/2017 Lee ..... F04D 13/0626
10,060,432 B2 * 8/2018 Pippes ..... F04C 29/023
10,458,414 B2 10/2019 Malvasi et al.
10,914,305 B2 2/2021 Rosinski et al.
11,454,235 B2 9/2022 Rosinski et al.
11,821,420 B2 11/2023 Graves et al.
2007/0177993 A1 8/2007 Nakamichi et al.
2012/0288380 A1 * 11/2012 Kaiser ..... F04C 15/008 417/321
2013/0259720 A1 * 10/2013 Mills ..... H02K 5/203 417/410.1
2013/0302142 A1 * 11/2013 Chiu ..... F04D 29/061 415/115
2014/0144412 A1 5/2014 An et al.
2014/0356200 A1 12/2014 Chan et al.
2015/0097450 A1 4/2015 Xu et al.
2016/0177962 A1 * 6/2016 Laing ..... F04D 29/061 417/423.13
2016/0281718 A1 * 9/2016 Zhang ..... F04D 29/588
2017/0067469 A1 * 3/2017 Malvasi ..... F01M 1/02
2018/0320778 A1 * 11/2018 Rosinski ..... F16H 57/12
2019/0003477 A1 * 1/2019 Graves ..... F04C 14/26
2022/0090597 A1 3/2022 Rosinski et al.
2023/0296094 A1 9/2023 Rosinski et al.

* cited by examiner

A Method 600 of Operating a Fluid Pump having a Thermistor Flow Path

THERMISTOR FLOW PATH

CROSS-REFERENCE TO RELATED APPLICATIONS

The present application is a continuation of U.S. patent application Ser. No. 17/544,215 filed Dec. 7, 2021, now U.S. Pat. No. 11,959,481, which is a continuation-in-part of U.S. patent application Ser. No. 17/141,265 filed Jan. 5, 2021, now U.S. Pat. No. 11,454,235, which is a continuation of U.S. patent application Ser. No. 15/590,248 filed May 9, 2017, now U.S. Pat. No. 10,914,305, which claims priority to and the benefit under 35 U.S.C. § 119 (e) of U.S. Provisional Patent Application No. 62/342,615, filed on May 27, 2016, all of which are entitled THERMISTOR FLOW PATH, the entire disclosures of which are hereby incorporated herein by reference.

FIELD OF THE INVENTION

The present invention generally relates to fluid pumps, and more specifically, fluid pumps with a temperature sensing mechanism.

BACKGROUND OF THE INVENTION

Fluid pumps can be included within various fluid reservoirs for moving a fluid from within the reservoir to within another portion of the mechanism. Such pumps are configured to be submerged within the reservoir.

SUMMARY OF THE INVENTION

According to one aspect of the present invention, a fluid pump includes a pump element in communication with an inlet and an outlet. Rotation of the pump element generates an inward suction at the inlet and outward pressure at the outlet that cooperatively moves a fluid through a fluid path. The pump element includes a stator and a rotor within a housing. An accessory fluid path is in communication with the inlet and the fluid path. An inlet orifice directs a portion of the fluid through the accessory fluid path. The accessory fluid path includes a low-restriction return path that provides a continuous flow of the fluid through the accessory fluid path and to an outlet orifice during operation of the pump element. A circuit board housing includes a contoured portion that aligns with one side of an outer wall. The circuit board housing includes a printed circuit board (PCB) with a thermistor in communication with contoured portion of the circuit board housing and the accessory fluid path. The inlet orifice and the contoured portion are positioned at opposing ends of the housing. The continuous flow is directed between the contoured portion and the outlet orifice between the rotor and the outer wall. The low-restriction return path between the contoured portion and the outlet orifice is configured to maintain a temperature of the continuous flow of the fluid within the contoured portion of the accessory fluid path to be similar to a temperature of the fluid in the fluid path.

According to another aspect of the present invention, a fluid pump includes a pump element in communication with a fluid path. The pump element includes a rotor and a stator within a housing. An inlet orifice is in communication with the pump element. The pump element and the inlet orifice direct a primary flow of a fluid to an outlet and an excess flow of the fluid into an accessory fluid path having a portion that extends between the rotor and an outer wall of the housing. A circuit board housing includes a contoured portion that aligns with the one side of the outer wall. The accessory fluid path includes a low-restriction return path that moves the excess flow of the fluid as a continuous flow through the accessory fluid path and toward an outlet orifice. The low-restriction return path is configured to maintain a temperature of the excess flow of the fluid in the contoured portion of the accessory fluid path to be similar to a temperature of the primary flow of the fluid. A thermistor is positioned in communication with the contoured portion to simultaneously monitor, in real time, the temperature of the excess flow of the fluid in the accessory fluid path and the temperature of the primary flow of the fluid in the fluid path.

According to another aspect of the present invention, a fluid pump includes a stator and rotor in electromagnetic communication and disposed within a housing. A pump element is attached to a first end of a drive shaft of the rotor. An inlet orifice is in communication with the pump element that diverts a primary flow of a fluid to an outlet and an excess flow of the fluid through the inlet orifice and into an accessory fluid path. An outlet orifice is in communication with the pump element. The outlet orifice directs excess fluid from the accessory fluid path to a primary fluid path. A circuit board housing is positioned at a second end of the drive shaft that opposes a first end. The circuit board housing includes a contoured portion that aligns with the one side of an outer wall of the housing. The accessory fluid path directs the excess flow of fluid along a linear path directly from the inlet orifice to the contoured portion. The accessory fluid path includes a low-restriction return path that moves the excess flow of the fluid as a continuous flow through the accessory fluid path and toward the outlet orifice. The low-restriction return path is configured to maintain a temperature of the excess flow of the fluid in the contoured portion of the accessory fluid path to be similar to a temperature of the primary flow of the fluid. A thermistor is positioned in communication with the contoured portion to simultaneously monitor, in real time, the temperature of the excess flow of the fluid in the accessory fluid path and the temperature of the primary flow of the fluid in the fluid path.

These and other aspects, objects, and features of the present invention will be understood and appreciated by those skilled in the art upon studying the following specification, claims, and appended drawings.

DETAILED DESCRIPTION OF THE PREFERRED EMBODIMENT

Figure 1:
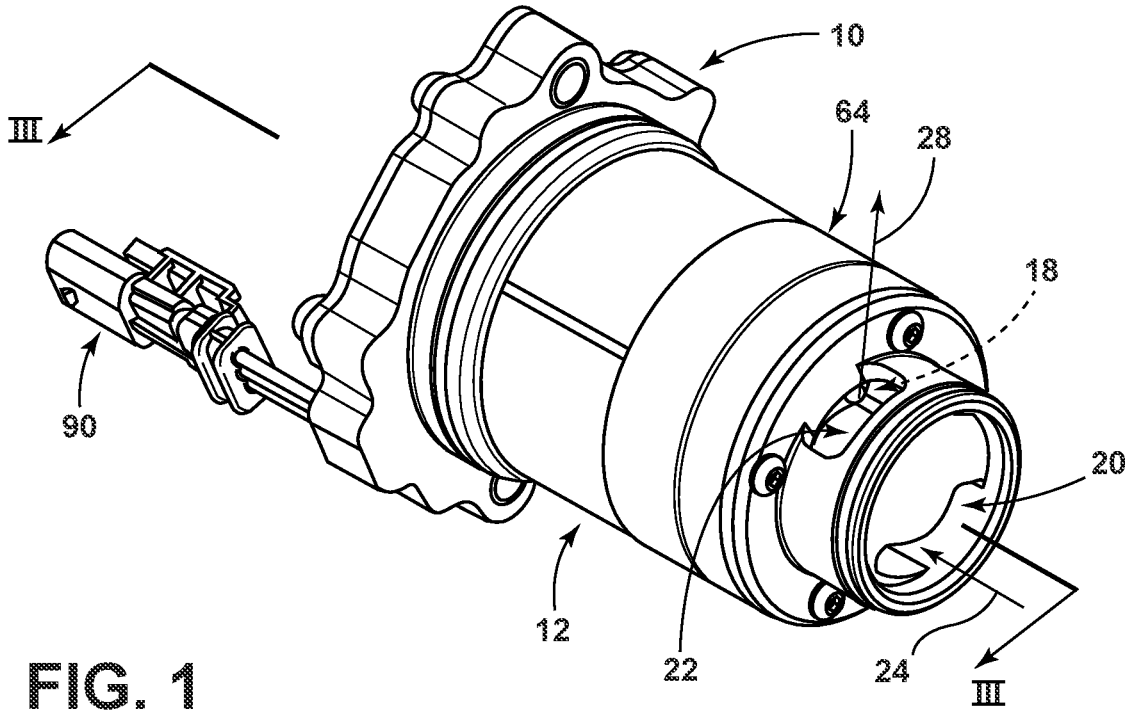
FIG. 1 is a first perspective view of a fluid pump incorporating an aspect of the thermistor fluid path.
Figure 2:
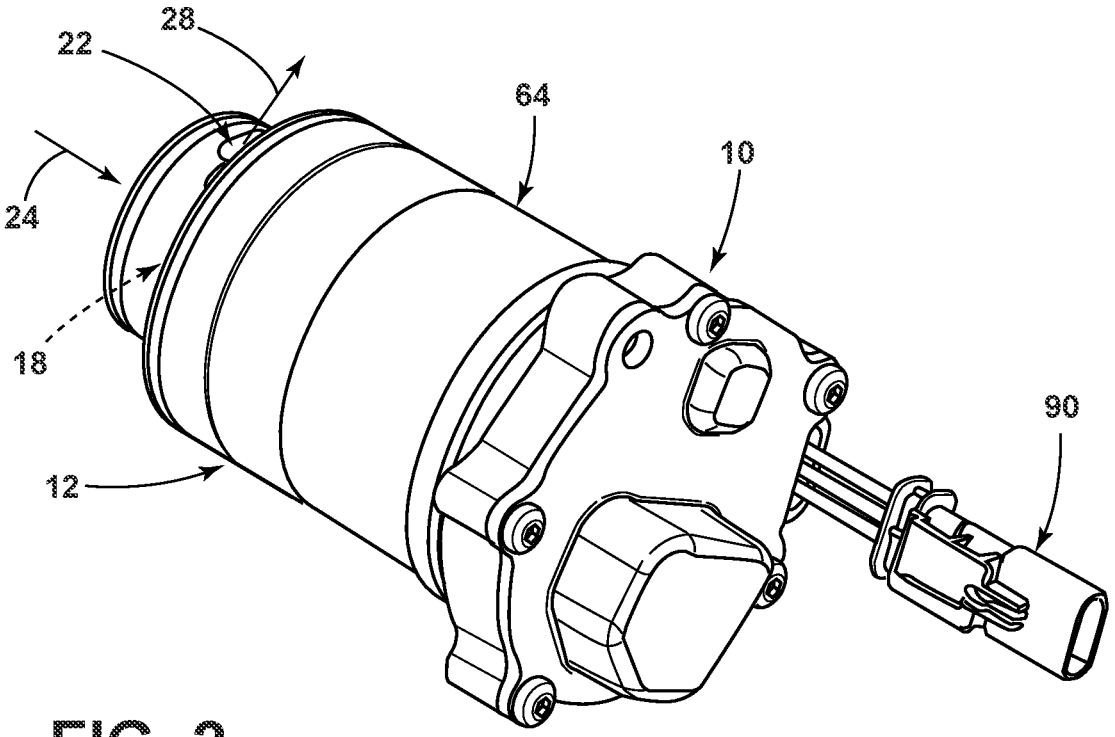
FIG. 2 is a second perspective view of the fluid pump of FIG. 1.
Figure 3:
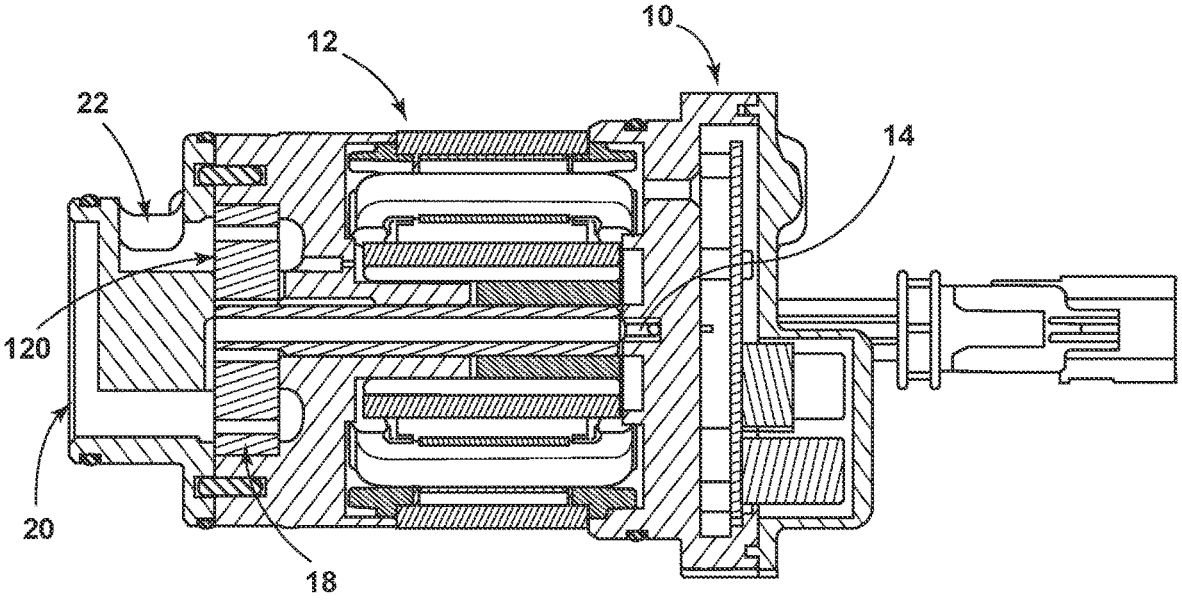
FIG. 3 is a cross-sectional view of the fluid pump of FIG. 1 taken along line III-III.
Figure 4:
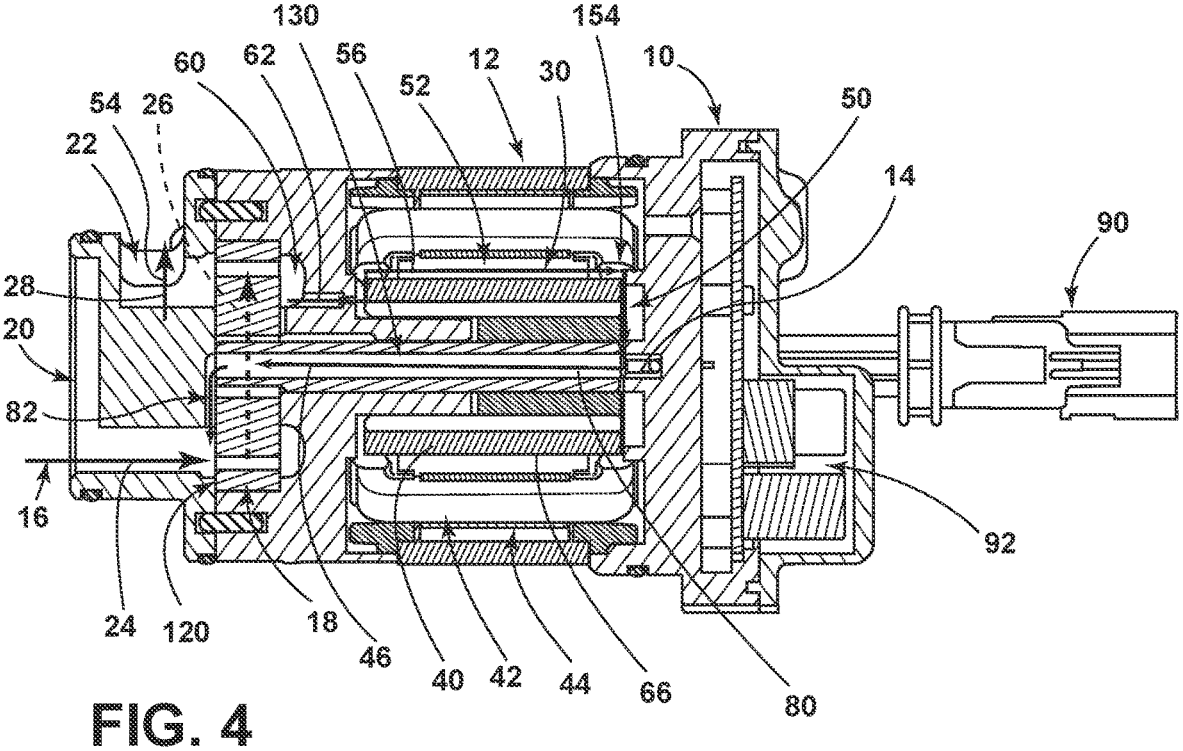
FIG. 4 is a cross-sectional view of the fluid pump of FIG. 3 illustrating a flow of a fluid through the thermistor flow path.
Figure 5:
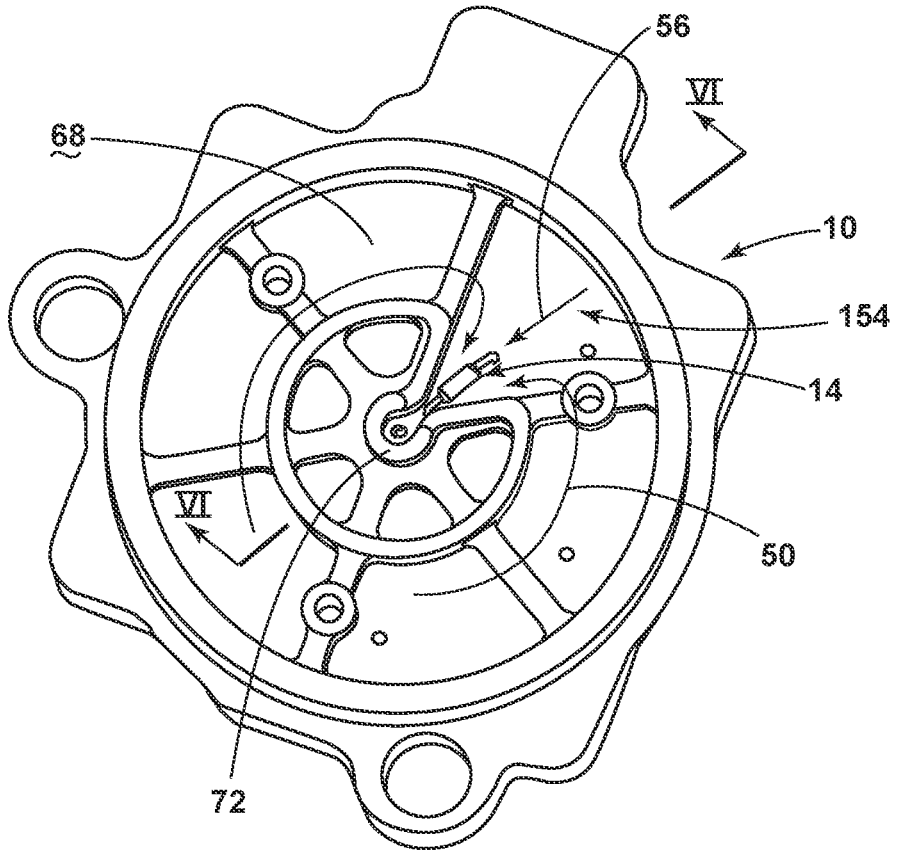
FIG. 5 is a perspective view of a printed circuit board (PCB) housing assembly for a fluid pump that incorporates an aspect of the thermistor.
Figure 6:
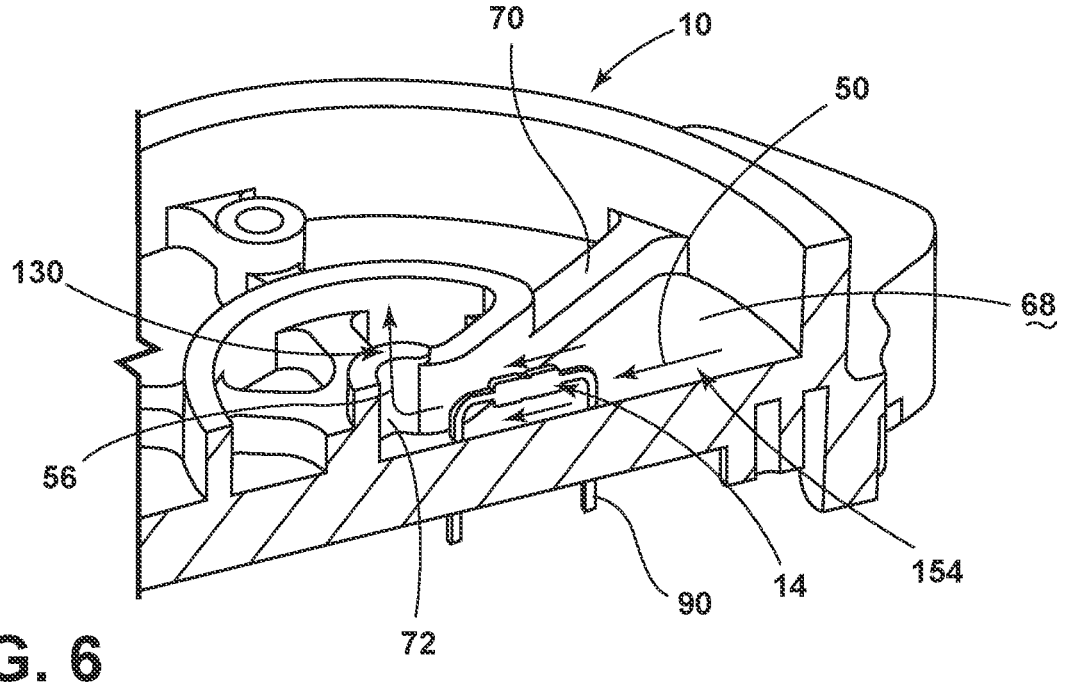
FIG. 6 is a cross-sectional perspective view of the PCB housing assembly of FIG. 5, taken along line VI-VI.
Figure 7:
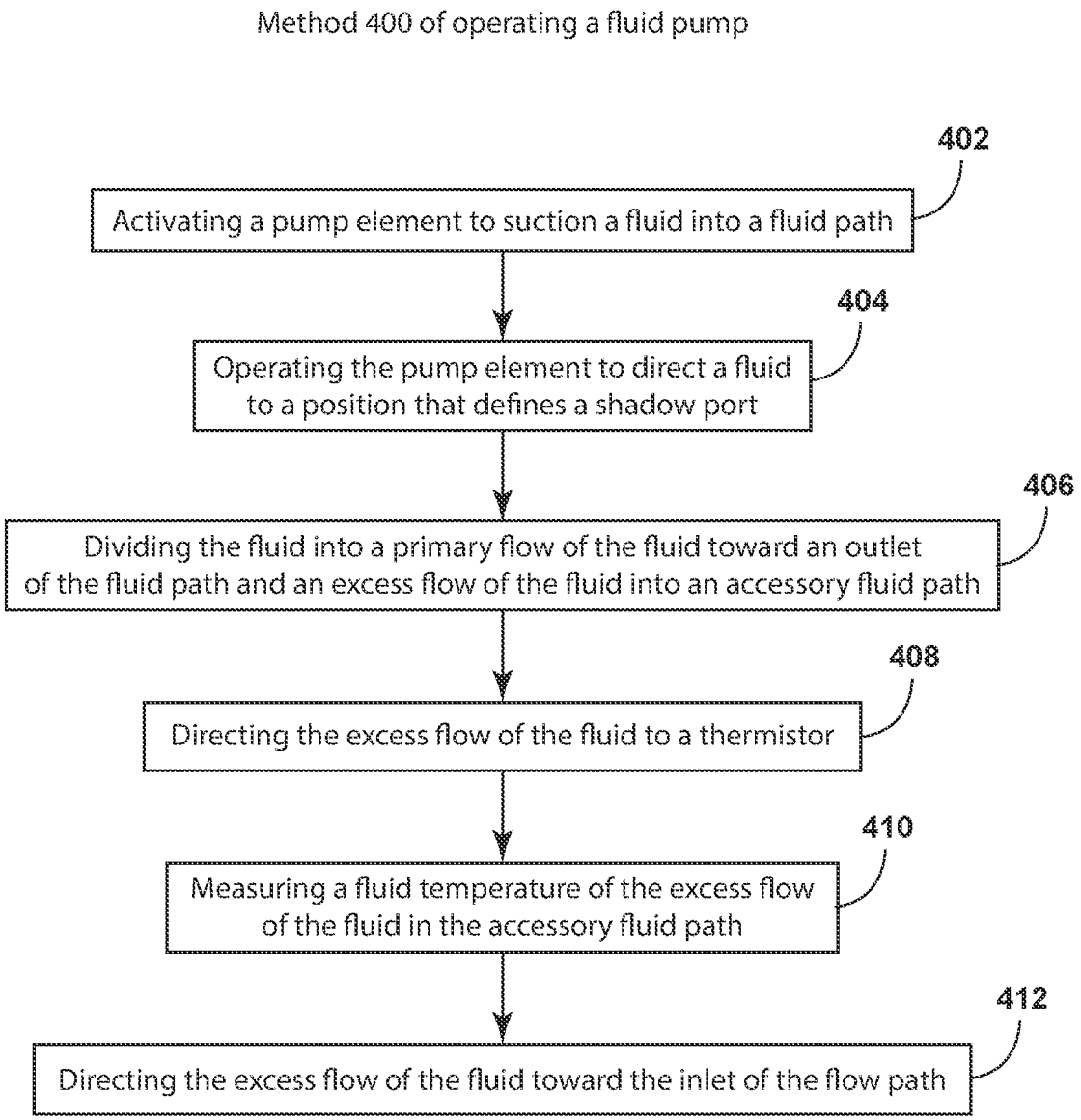
FIG. 7 is a schematic flow diagram illustrating a method for operating a fluid pump.
Figure 8:
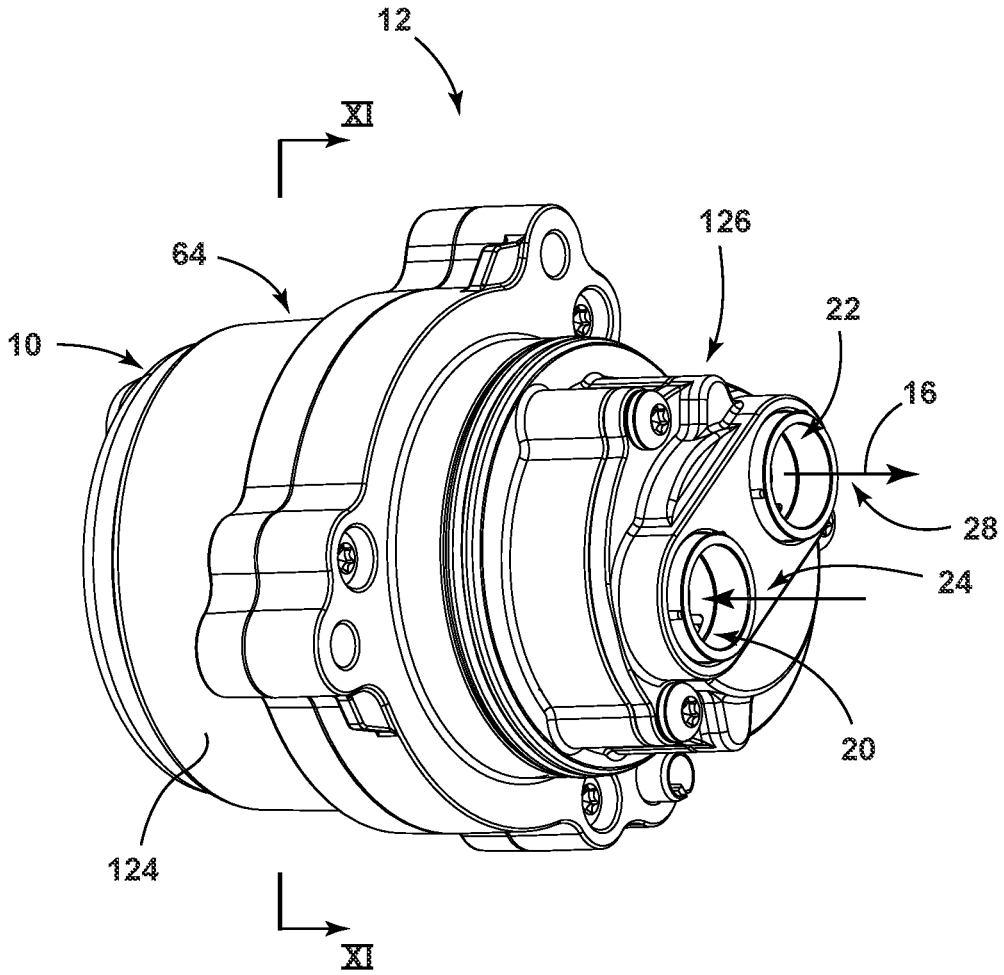
FIG. 8 is a side perspective view of a fluid pump incorporating an aspect of the thermistor flow path.
Figure 9:
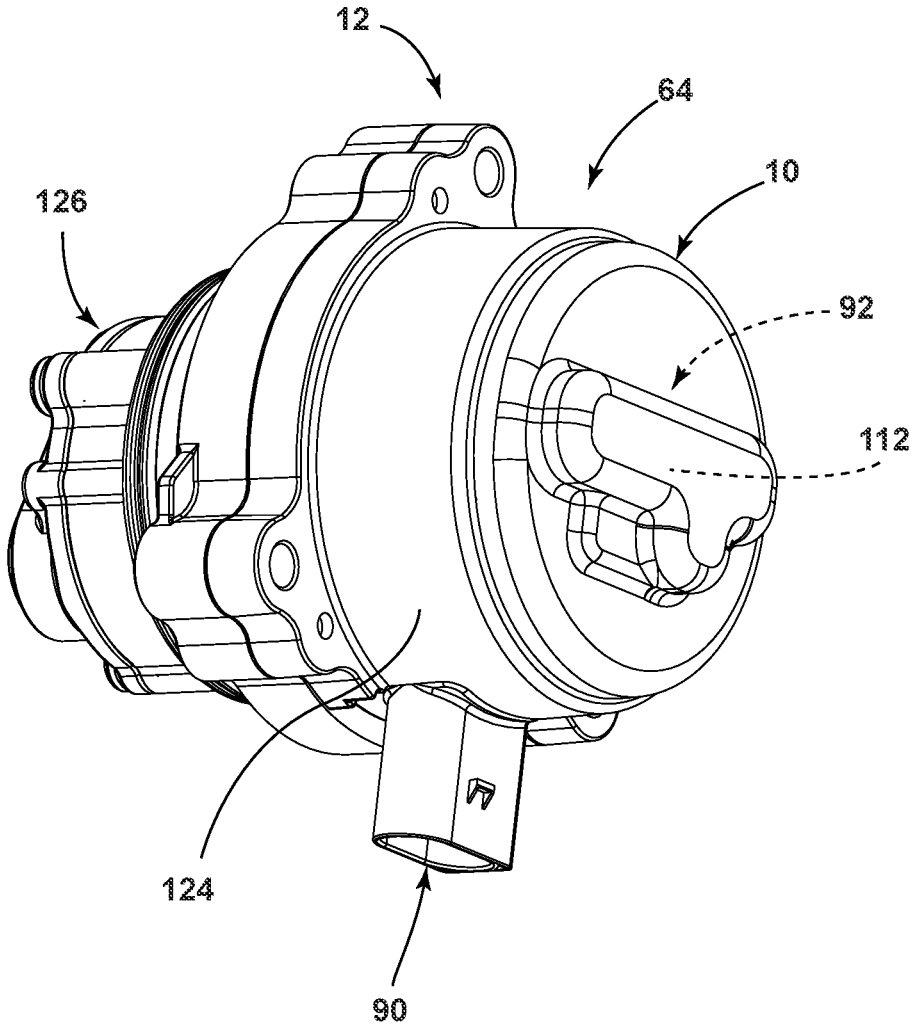
FIG. 9 is a side perspective view of the fluid pump of FIG. 8.
Figure 10:
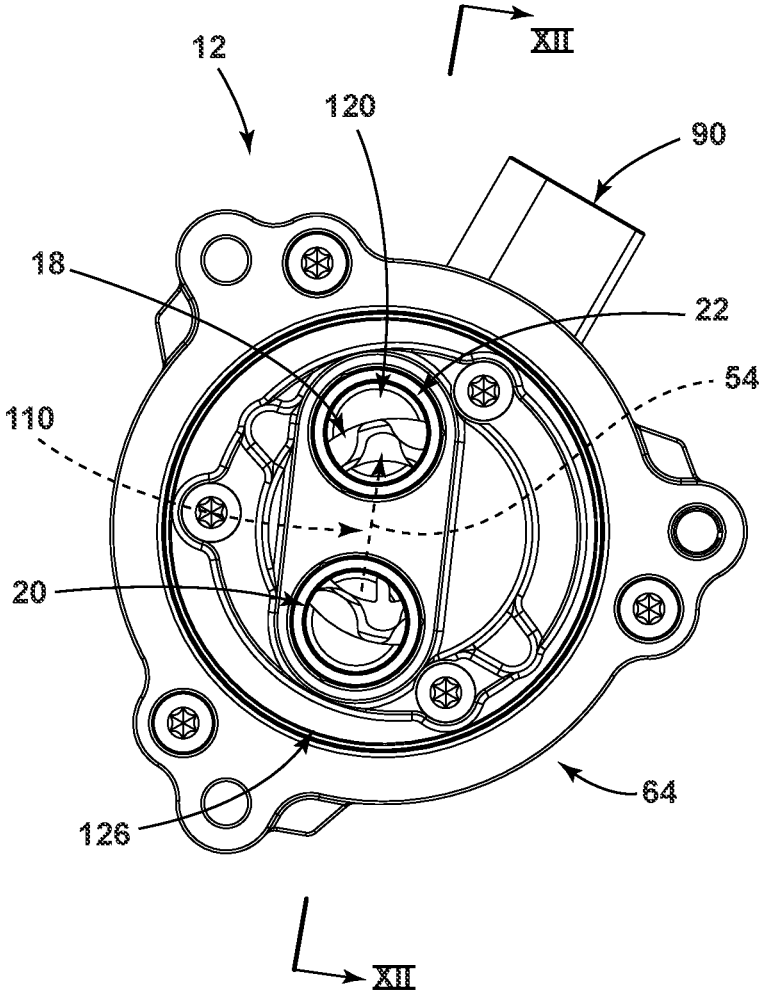
FIG. 10 is an end elevation view of the fluid pump of FIG. 8 and showing aspects of the pump element.
Figure 11:
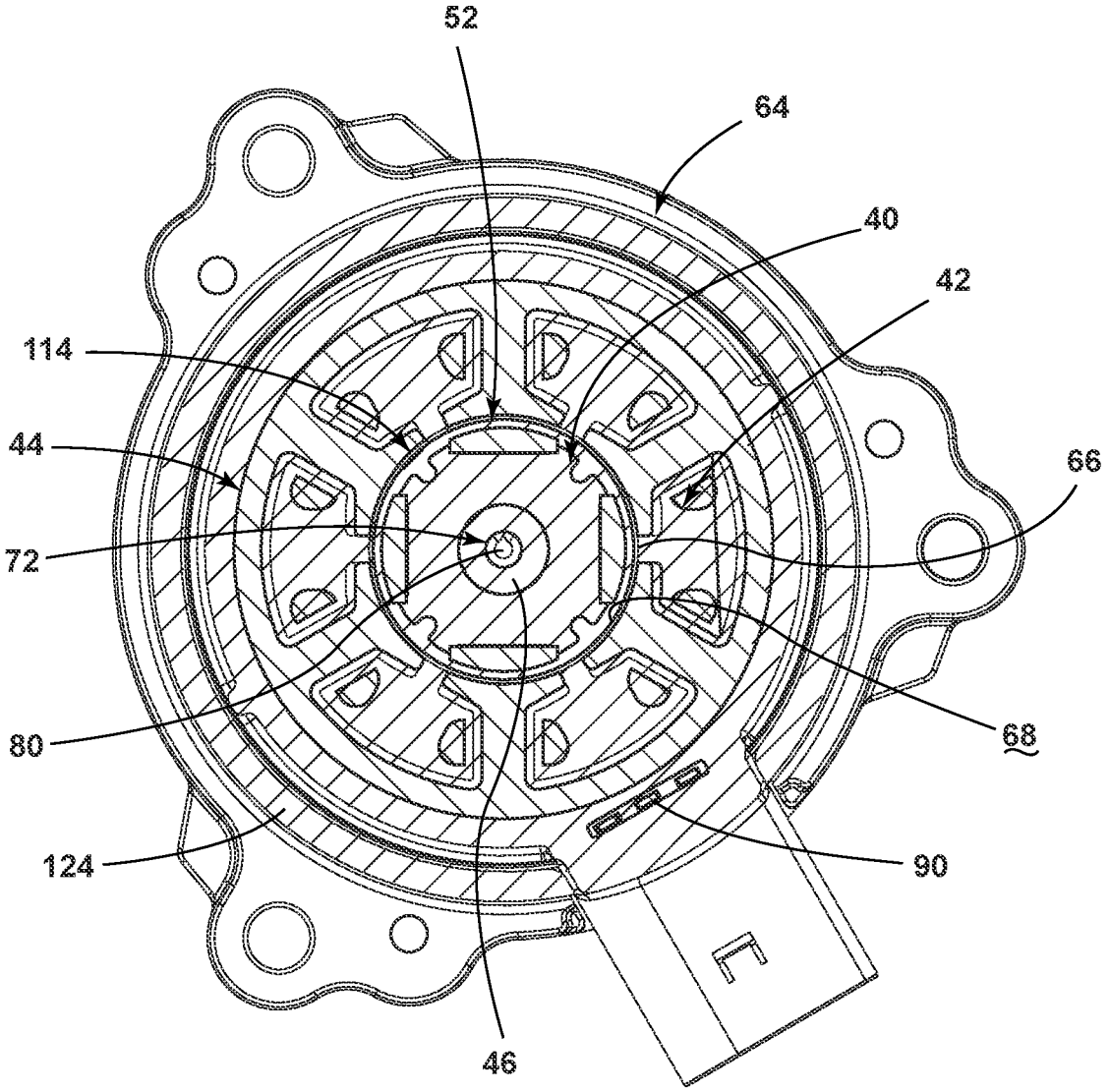
FIG. 11 is a cross-sectional view of the fluid pump of FIG. 8 taken along line XI-XI.
Figure 12:
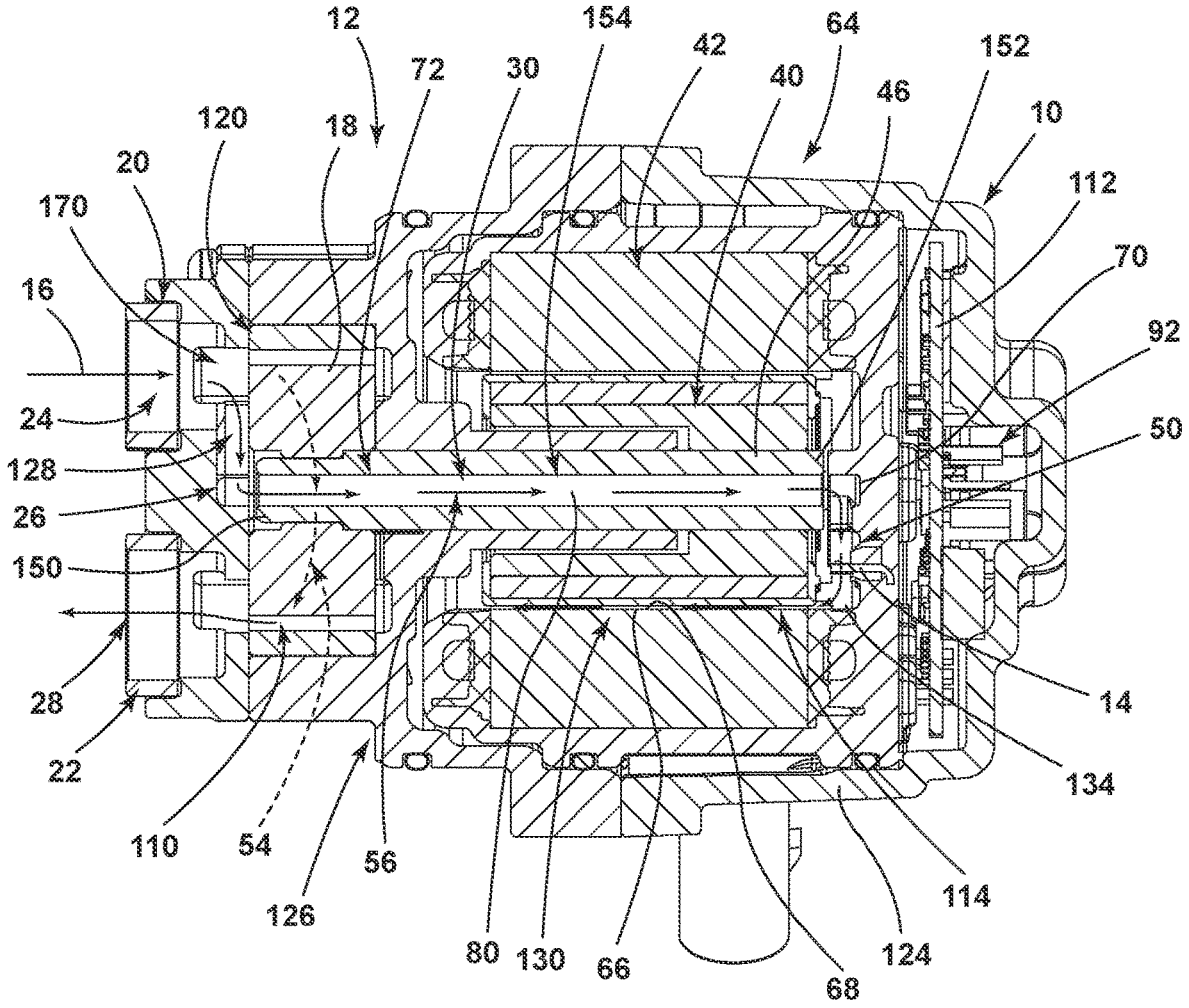
FIG. 12 is a cross-sectional view of the fluid pump of FIG. 10 taken along line XII-XII.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As shown in FIGS. 1-6, reference numeral 10 generally refers to a printed circuit board (PCB) housing assembly for a fluid pump 12 that incorporates a thermistor 14 for measuring the temperature of fluid 16 being passed through the fluid pump 12. The fluid pump 12 includes a pump element 120, such as a generated rotor or gerotor 18, or other similar positive displacement pump, in communication with an inlet 20 and an outlet 22 of the fluid pump 12. Activating rotation of the gerotor 18 generates a suction 24, or inward pressure, at the inlet 20 that draws fluid 16 into the fluid path 26 and outward pressure 28 at the outlet 22 that pushes fluid 16 out of the fluid path 26. The suction 24 and outward pressure 28 generated through operation of the gerotor 18 cooperate to move the fluid 16 through the fluid path 26. An accessory fluid path 30, which defines a portion of the fluid path 26, is disposed in communication with the inlet 20 and outlet 22. The accessory fluid path 30 includes the thermistor 14 that is placed in communication with fluid 16 flowing through the accessory fluid path 30. The thermistor 14 is adapted to monitor a temperature of the fluid 16 moving through the accessory fluid path 30 of the fluid pump 12.

Referring again to FIGS. 1-6, a fluid pump 12, such as an electric oil pump, generally provides lubrication and cooling to various mechanisms, such as a gear box, differential unit, or other similar mechanism. The fluid pump 12, typically in the form of a gerotor 18, brushless DC (BLDC) electric motor 44, and a controller can be fully integrated into a housing assembly that manages the sealing, thermal transfer and part assembly for the electric fluid pump 12. The fluid pump 12 can include a rotor 40 and stator 42 that make up the motor 44 for the fluid pump 12. A drive shaft 46 is driven by rotation of the rotor 40 and serves to rotate the gerotor 18 for generating the suction 24 and outward pressure 28 for moving fluid 16 through the fluid path 26 and, in turn, the accessory fluid path 30.

Referring again to FIGS. 1-6, the accessory fluid path 30, in the form of a thermistor flow path 50, serves to provide a fluid pump 12 with a temperature sensing functionality for providing real time measurements regarding fluid temperature during operation of the fluid pump 12. The temperature sensor can be a thermistor-style leaded component that is installed in the same cavity as the rotor assembly 52 that serves to drive the gerotor 18. Typically, this cavity is "wet" as the rotor 40 is submerged in fluid 16, such as oil. Within the fluid pump 12, the fluid 16 moving through the gerotor 18 flows through an outlet shadow port 60 having an orifice 62 that helps to regulate and divide the flow of fluid 16 through the fluid path 30 of the fluid pump 12, as will be described more fully below.

The fluid 16 is divided between a regulated primary flow 54 of the fluid 16 and the remaining fluid 16 that defines an excess flow 56 of the fluid 16. In regulating the flow of fluid 16 from the outlet shadow port 60 and orifice 62, the primary flow 54 is a predetermined amount of the fluid 16 that is directed to the outlet 22. By dividing the fluid 16, the excess flow 56 of fluid 16 that is not part of the regulated primary flow 54 of the fluid 16 is directed through the orifice 62 and into the accessory fluid path 30. In this manner, the gerotor 18 pushes the primary flow 54 of the fluid 16 through the outlet 22 and simultaneously pushes the excess flow 56 of the fluid 16 through the orifice 62 and into the accessory fluid path 30. Directing the movement of the excess flow 56 of fluid 16 helps to ensure that there is a continuous or substantially continuous flow 154 of fluid 16 across the thermistor 14. Additionally, this configuration of the accessory fluid path 30 in relation to the outlet shadow port 60 and orifice 62 also helps to ensure that the temperature of the excess flow 56 of the fluid 16 is at least substantially similar to the primary flow 54 of fluid 16 that is directed through the outlet 22. This configuration helps to provide real time or substantially real time temperature measurements of the fluid 16.

In this disclosed device, the accessory fluid path 30 is placed in communication with the outlet shadow port 60 through the orifice 62 that controls the excess flow 56 of the fluid 16 from the outlet shadow port 60 and into the accessory fluid path 30. From the orifice 62 at the outlet shadow port 60, the excess flow 56 of fluid 16 flows around at least a portion of the rotor assembly 52, but within the housing 64 of the fluid pump 12. After passing along the side 66 of the rotor assembly 52, the excess flow 56 of fluid 16 is directed along an inner surface 68 of the PCB housing assembly 10 where the thermistor 14 is located. The inner surface 68 of the PCB housing assembly 10 includes contours 70 that are configured to direct the excess flow 56 of fluid 16 from the sides 66 of the rotor assembly 52 along the contours 70, into engagement with the thermistor 14, and to a central portion 72 of the PCB housing assembly 10. In this manner, the contours 70 and central portion 72 of the inner surface 68 of the PCB housing assembly 10 at least partially defines the thermistor flow path 50 and the accessory fluid path 30. The central portion 72 of the PCB housing assembly 10 is in communication with a channel 80 of the drive shaft 46. This channel 80 of the drive shaft 46 extends through the center of the drive shaft 46 and the rotor assembly 52 and up through the gerotor 18 and to a recirculation path 82 that recombines the excess flow 56 of the fluid 16 with fluid 16 entering the inlet 20. In this manner, the excess flow 56 of the fluid 16 is drawn back into the inlet 20 by the suction 24 generated by the gerotor 18. The recombined fluid 16 is then delivered via the gerotor 18 and is divided into the primary and excess flows 54, 56 of fluid 16 as described above. In this configuration, a portion of the excess flow 56 upon leaving the recirculation path 82 may be divided again as part of the excess flow 56. It is contemplated that the excess flow 56 from the recirculation path 82 will be sufficiently mixed with the fluid 16 entering the inlet 20. Accordingly, the amount of the excess flow 56 that is divided again into a portion of the excess flow 56 is substantially minimal. The effects of a portion of the excess flow 56 being directly recirculated again through the accessory fluid path 30 as part of the excess flow 56 will have minimal effects on the temperature measurements of the thermistor 14.

In various embodiments, the recirculation path 82 may direct the excess flow 56 of fluid 16 from the accessory fluid path 30 to the outlet 22 of the fluid pump 12. In this manner, the excess flow 56 can be at least partially re-combined with the primary flow 54 of fluid 16 that is moved through the outlet 22.

Referring again to FIGS. 1-6, the return path 130 of the fluid 16 within the accessory fluid path 30 and through the central channel 80 of the drive shaft 46 forces the excess flow 56 of the fluid 16 to flow directly over the thermistor 14. Accordingly, temperature measurements of the excess flow 56 of the fluid 16 moving through the thermistor flow path 50 can be taken by the thermistor 14 in real time or substantially in real time. The amount of fluid 16 moving through the accessory fluid path 30 is controlled by the size of the orifice 62 on the high pressure side of the fluid path 26. Additionally, the return path 130 of the accessory fluid path 30 is maintained at a lower restriction to prevent a pressure build-up within the motor cavity 114. In order to deliver the signal from the thermistor 14 within the PCB housing assembly 10, terminals 90 are used to connect the thermistor 14 to the PCB housing assembly 10. These terminals 90 are sealed to prevent leaking into the PCB cavity 92 on the opposite side of the thermistor 14.

Within conventional fluid pumps 12, very little fluid 16 is moved in and around the motor cavity 114. As such, placing a thermostat or other temperature sensing device within this area provides little, if any, temperature-related information.

Referring again to FIGS. 1-6, the accessory fluid path 30 that provides the thermistor flow path 50 provides a convenient and accurate mechanism for measuring the temperature of the fluid 16 flowing through the fluid pump 12 while not diminishing the performance of the fluid pump 12.

It is contemplated that the fluid pump 12 described herein can be used in various applications that can include, but are not limited to, fuel pumps, oil pumps, water pumps, combinations thereof, and other fluid pumps 12 that may be submerged or non-submerged.

It is contemplated that the PCB housing assembly 10 and terminals 90 can be incorporated within new pumps or can be manufactured for installation with after-market pumps.

Having described various aspects of the device, a method 400 is disclosed for operating the fluid pump 12. This method 400 includes step 402 of activating a pump element 120 to draw a fluid 16 into a fluid path 26. The pump element 120 operates to direct a fluid 16 to a position that defines a shadow port 60 (step 404). The fluid 16 is divided into a primary flow 54 of the fluid 16 toward an outlet 22 of the fluid path 26 and an excess flow 56 of the fluid 16 through an orifice 62 of the shadow port 60 and into an accessory fluid path 30 (step 406). The excess flow 56 of the fluid 16 is directed to a thermistor 14 (step 408). A fluid temperature of the excess flow 56 of the fluid 16 in the accessory fluid path 30 is measured (step 410). The excess flow 56 of the fluid 16 is directed toward the inlet 20 of the fluid path 26 (step 412).

Referring now to FIGS. 1-6 and 8-16, the fluid pump 12, as discussed herein, can incorporate various fluid paths 26 that can include, but are not limited to, a primary fluid path 110, the accessory fluid path 30, and other similar fluid paths 26 through which the fluid 16 can translate within the fluid pump 12. In each of these aspects, at least one of these fluid paths 26 is configured to monitor, in real time, the fluid temperature of the excess flow 56 of fluid 16 within the accessory fluid path 30. This temperature reading, due to the configuration of the accessory fluid path 30, is similar to a temperature of the primary flow 54 of the fluid 16 within the primary fluid path 110. The various configurations of the accessory fluid path 30 provide for a direct and generally linear path for the excess flow 56 of fluid 16 to move from the inlet 20 and to the thermistor flow path 50 that is in communication with the thermistor 14 of the PCB 112.

According to various aspects of the device, the pump element 120 is in communication with the inlet 20 and the outlet 22 for the fluid pump 12. Rotation of the pump element 120 generates an inward suction 24 through the inlet 20 and an outward pressure 28 through the outlet 22 that cooperatively moves the fluid 16 through the fluid path 26. The pump element 120 includes the stator 42 and rotor 40 that are positioned within a motor cavity 114 of the housing 64. The housing 64 includes the outer wall 124, a pump housing 126 that surrounds the pump element 120 and a circuit board housing assembly 10 that houses the PCB 112 and the various components disposed thereon. The accessory fluid path 30 is in communication with the inlet 20 and the fluid path 26. An inlet orifice 128 directs a portion of the fluid 16, typically in the form of the excess flow 56 of fluid 16, through the accessory fluid path 30. During operation of the pump element 120, the accessory fluid path 30 includes a low-restriction return path 130 that provides a continuous flow 154 of fluid 16 through the accessory fluid path 30 and to an outlet orifice 132. The circuit board housing assembly 10 includes the contoured portion 134 that extends toward one side 66 of the outer wall 124 of the housing 64. The thermistor 14 is positioned on the PCB 112 within the circuit board housing assembly 10.

As discussed herein, the thermistor 14 is at least in communication with the contoured portion 134 of the circuit board housing assembly 10. In certain aspects of the device, the thermistor 14 can extend into the thermistor flow path 50 that is defined by the contoured portion 134 of the circuit board housing assembly 10. The inlet orifice 128 and the contoured portion 134 are positioned at opposing ends of the housing 64. Through this configuration, a drive shaft 46 of the rotor 40 is positioned such that the inlet orifice 128 is located at a first end 150 of the drive shaft 46 and the contoured portion 134 of the circuit board housing assembly 10 is positioned at an opposing second end 152 of the drive shaft 46 for the rotor 40. The continuous flow 154 of the fluid 16 that is provided through the low-restriction return path 130 is directed between the contoured portion 134 and the outlet orifice 132 such that the fluid 16 moves between the rotor 40 and the inner surface 68 of the outer wall 124, and more particularly, between the rotor 40 and the stator 42.

In addition, the low-restriction return path 130 between the contoured portion 134 and the outlet orifice 132 is configured to maintain a temperature of the continuous flow 154 of the fluid 16 within the contoured portion 134 of the accessory fluid path 30 to be similar to the temperature of the fluid 16 as it enters the inlet 20 and moves through the primary fluid path 110. Through this configuration, the temperature of the continuous flow 154 of fluid 16 within the contoured portion 134 of the accessory fluid path 30 is similar to a temperature of the fluid 16 that is within the primary fluid path 110 moving through the pump element 120 between the inlet 20 and the outlet 22. As discussed herein, the thermistor 14 is positioned in communication with the contoured portion 134 of the circuit board housing assembly 10. This is to simultaneously monitor, in real time, the temperature of the continuous flow 154 of the fluid 16 in the accessory fluid path 30 and also the temperature of the fluid 16 within the primary fluid path 110. Because the temperature of the fluid 16 in these two locations, which are positioned at opposite ends of the motor cavity 114 for the fluid pump 12, have a similar temperature, the thermistor 14 within the contoured portion 134, or in communication with the contoured portion 134, is sufficient to provide a temperature reading with respect to both locations.

Referring again to FIGS. 3-6 and 12-16, the inlet orifice 128 directs a portion of the fluid 16 from the inlet 20 to the central channel 80 of the pump element 120. This central channel 80 extends through the drive shaft 46 of the rotor 40. The central channel 80 of the drive shaft 46 extends from the inlet orifice 128 and to the contoured portion 134 of the circuit board housing assembly 10. Through this configuration, the excess fluid 16 moving through the accessory fluid path 30 is moved directly, and generally linearly, from the inlet orifice 128, through this central channel 80 and to the contoured portion 134. This portion of the accessory fluid path 30 moves the fluid 16 quickly to the thermistor flow path 50 so that any heat that may be generated by the motor 44 and the PCB 112 does not alter, or appreciably alter, the temperature of the fluid 16 in the accessory fluid path 30. In this manner, the thermistor 14 is able to provide the real time measurement of the temperature of the fluid 16 within each of the contoured portion 134 (the thermistor flow path 50) as well as the primary fluid path 110 through the pump element 120.

Referring again to FIGS. 10-16, the outlet orifice 132 is positioned to align with a diverging portion 170 of the inlet orifice 128. This diverging portion 170 of the inlet orifice 128 is where the fluid 16 moving through the inlet 20 is diverted to move either into the inlet orifice 128 and through the accessory fluid path 30, or into the pump element 120 to be moved through the primary fluid path 110 of the pump element 120 and to the outlet 22. The outlet orifice 132 is positioned near the opposing surface of the pump element 120. In this manner, the inlet orifice 128 is positioned near the inlet 20 and the outlet orifice 132 is positioned near the stator 42 and the rotor 40. As discussed in greater detail herein, the outlet orifice 132 receives the excess flow 56 of fluid 16 that has moved through the accessory fluid path 30.

Figure 13:
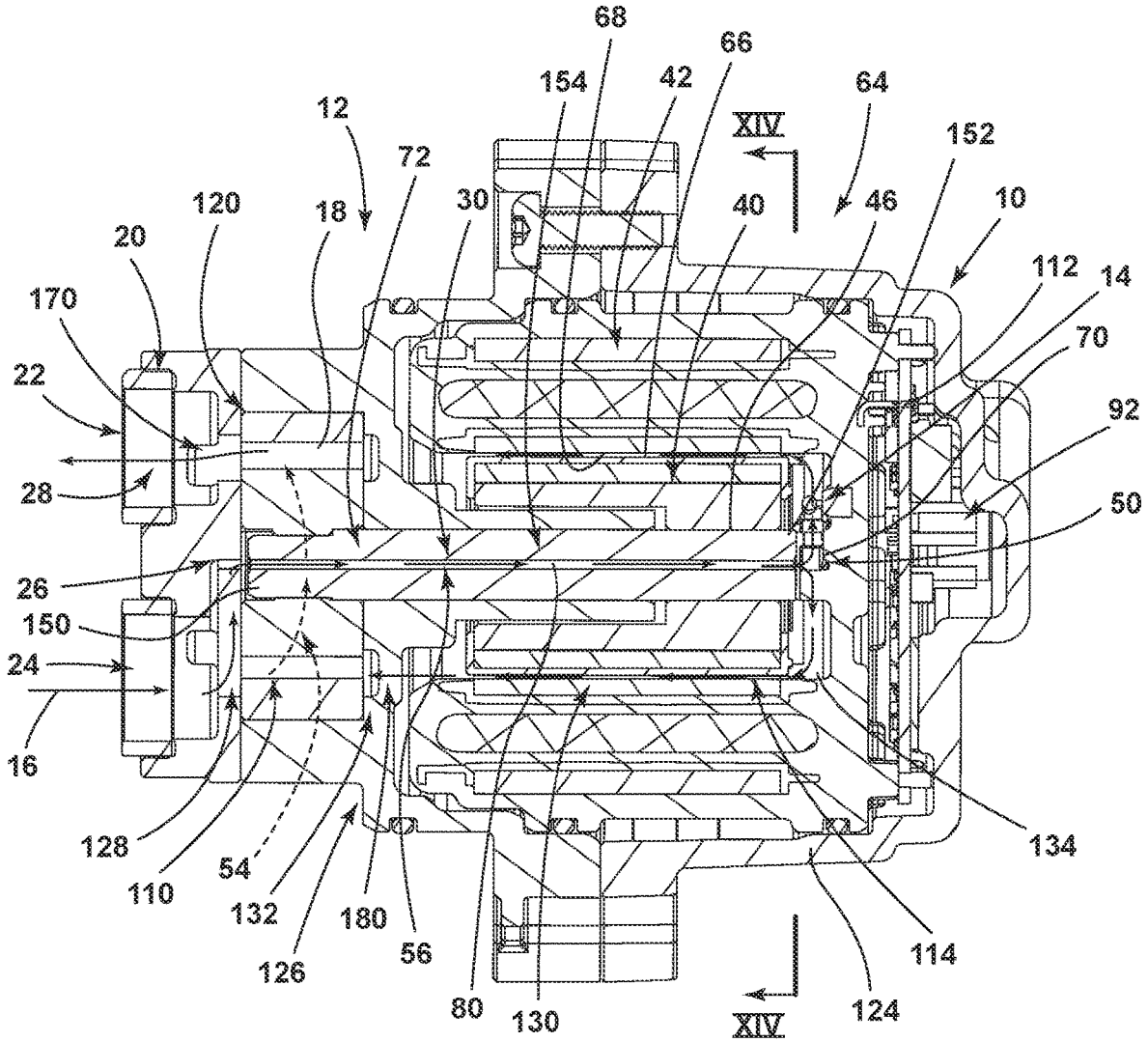
FIG. 13 is a schematic cross-sectional view of an aspect of the fluid pump of FIG. 8 and showing movement of the fluid through the primary fluid path and the accessory fluid path for the fluid pump.
Figure 14:
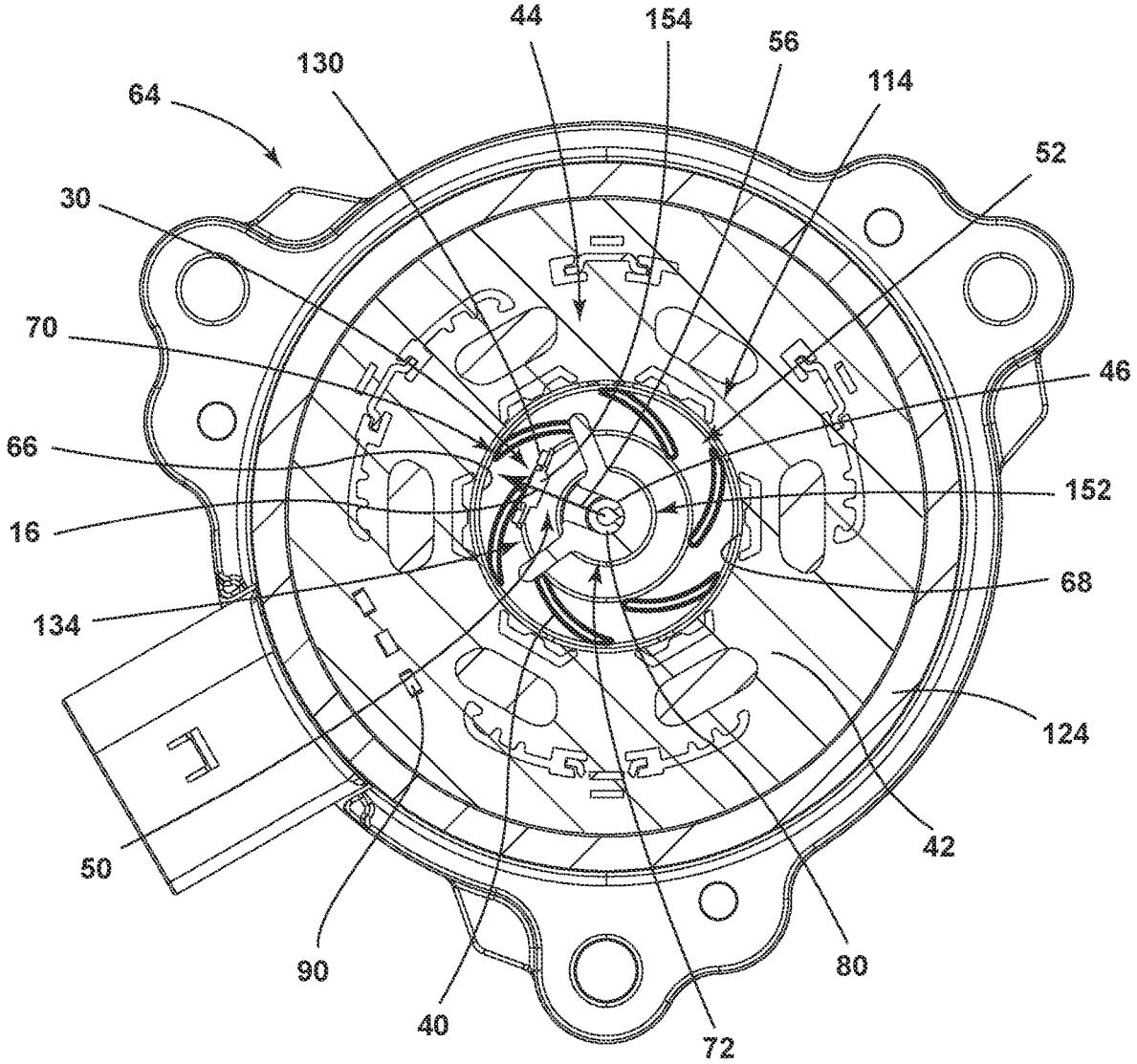
FIG. 14 is a schematic cross-sectional view of the fluid pump of FIG. 8 and showing movement of fluid through the thermistor fluid path.
Figure 15:
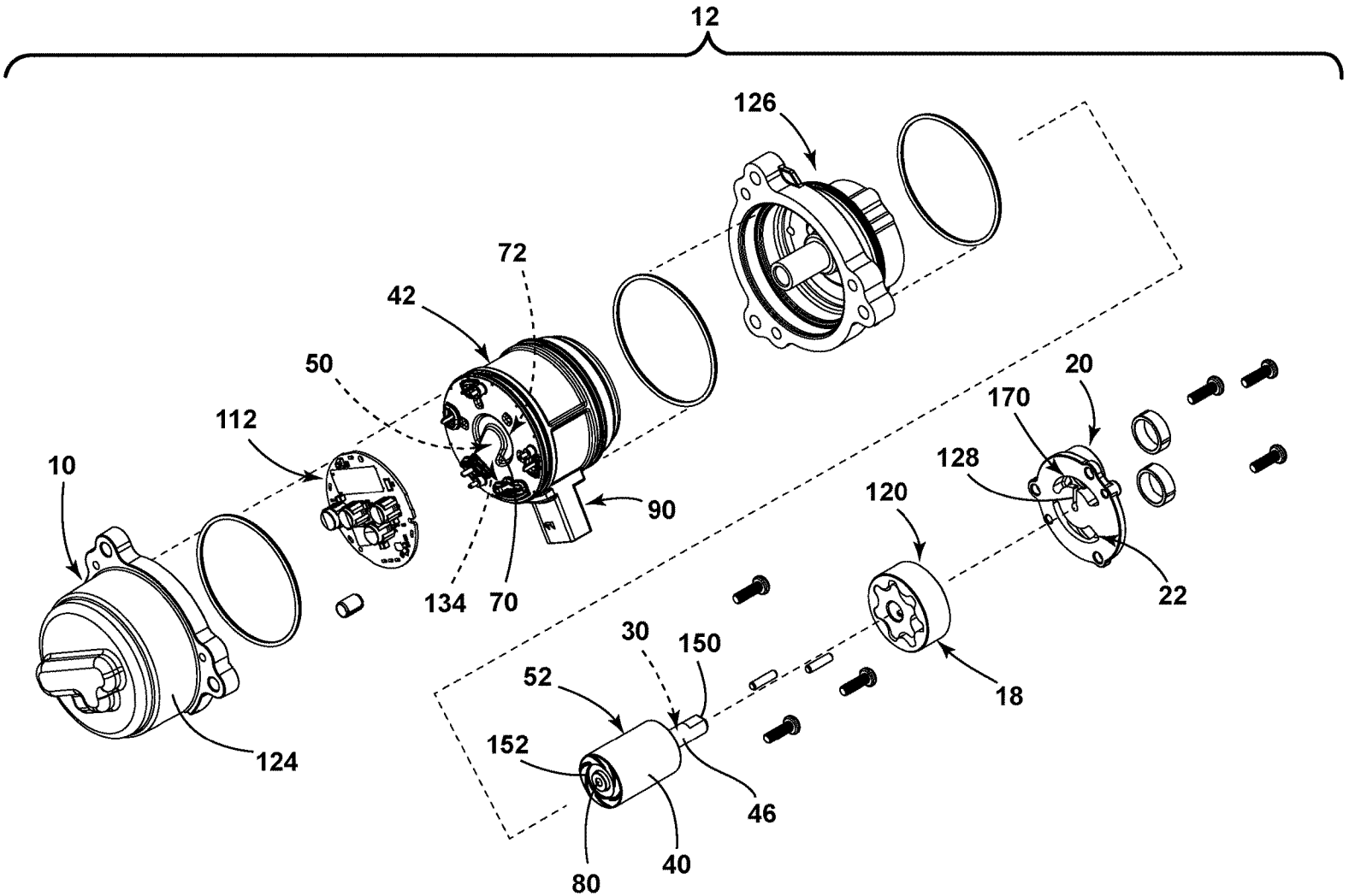
FIG. 15 is an exploded perspective view of the fluid pump of FIG. 8.
Figure 16:
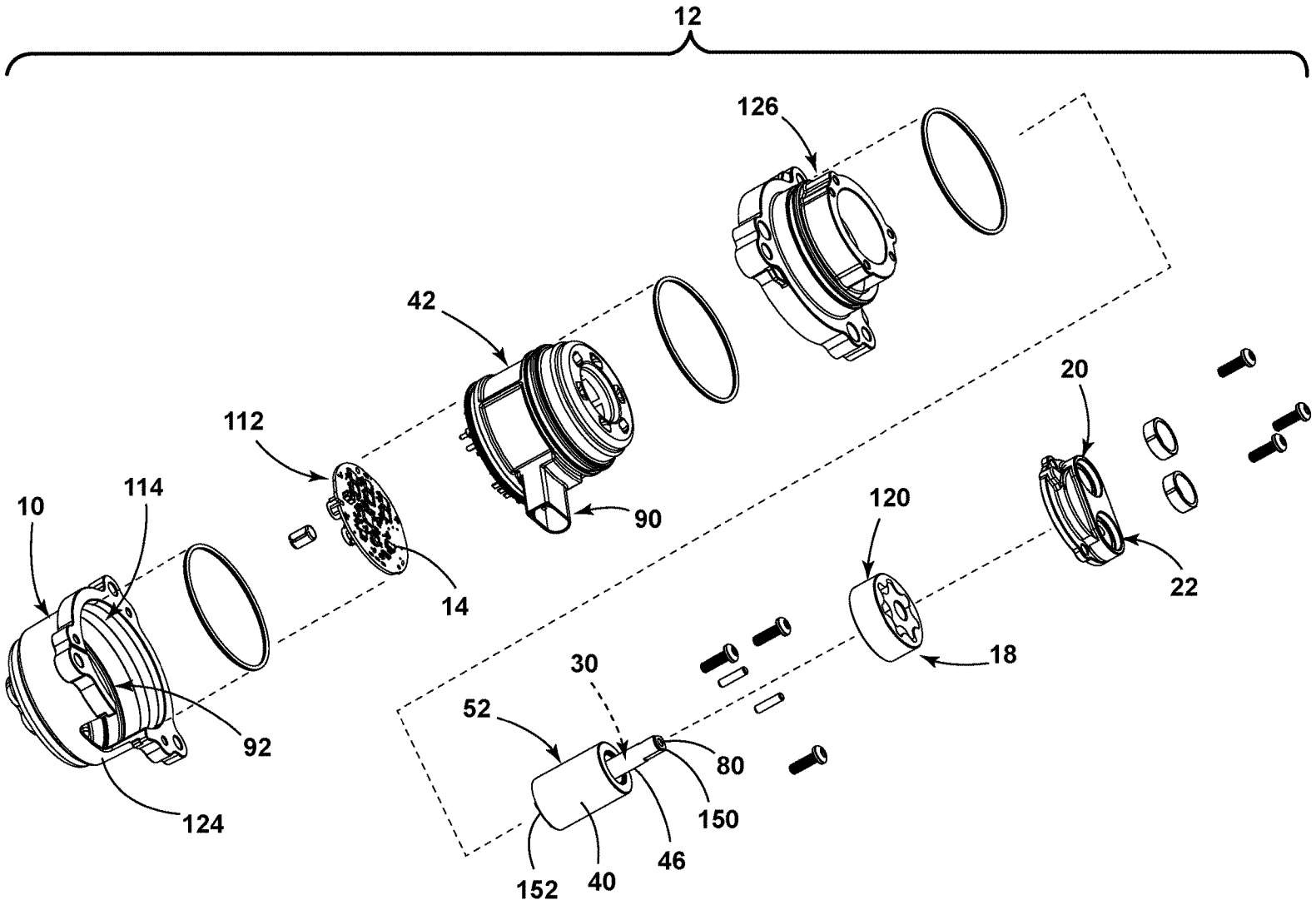
FIG. 16 is another exploded perspective view of the fluid pump of FIG. 8.
Figure 17:
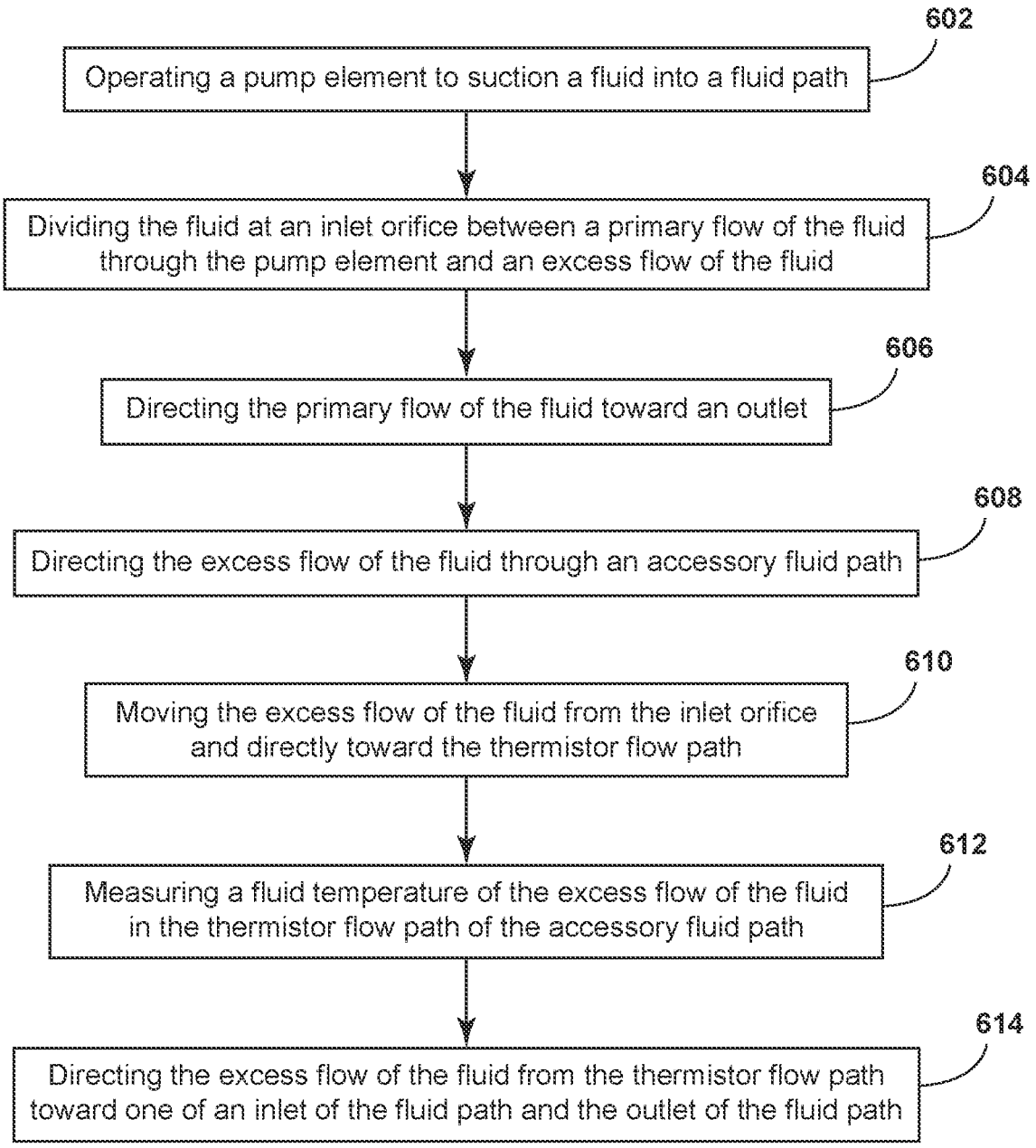
FIG. 17 is a schematic flow diagram illustrating a method for operating a fluid pump.

As exemplified in FIG. 13, the diverging portion 170 of the inlet orifice 128 operates to divert a portion of the fluid 16, the excess flow 56, from the inlet 20 and into the accessory fluid path 30 before the fluid 16 is able to reach the pump element 120. At a downstream position of the accessory fluid path 30, the outlet orifice 132 and the pump element 120 receive the excess flow 56 of the fluid 16 from the accessory fluid path 30 and direct this excess flow 56 of fluid 16 toward the outlet 22 via the primary fluid path 110 within the pump element 120. Through this configuration, the inlet orifice 128 and the outlet orifice 132 are each positioned proximate the pump element 120. The outlet orifice 132 and the pump element 120 regulates a flow of the fluid 16 into the fluid path 26 and also regulates the flow of excess fluid 16 into the accessory fluid path 30. Accordingly, the primary flow 54 of the fluid 16 moving through the fluid pump 12 is typically configured to move either from the inlet 20, through the primary fluid path 110, and to the outlet 22. In addition, the excess flow 56 of the fluid 16 moves from the inlet 20, into the inlet orifice 128 and to the thermistor flow path 50. From the thermistor flow path 50, the excess flow 56 of the fluid 16 moves to the outlet orifice 132 to be rejoined with the primary flow 54 of the fluid 16. At this point, the primary flow 54 and the excess flow 56 are rejoined and are moved to the outlet 22 via the primary fluid path 110.

As discussed herein, and as exemplified in FIGS. 10-16, the pump element 120 at the inlet 20 generates the inward suction 24 to draw fluid 16 into the flow path that moves through the pump element 120. A portion of this inward suction 24 is used to draw the excess fluid 16 from the outlet orifice 132 and into the pump element 120 and the primary fluid path 110. This portion of the suction 24 at the outlet orifice 132 also serves to draw or suction the excess flow 56 of fluid 16 from the inlet 20 and into the inlet orifice 128 to be moved through the accessory fluid path 30. Accordingly, the outlet orifice 132 and pump element 120 cooperate to form a suction interface 180 that draws the excess fluid 16 into the accessory fluid path 30. This suction interface 180 also serves to draw the excess flow 56 of the fluid 16 in a substantially linear and direct manner from the inlet orifice 128 and to the thermistor flow path 50. Also, the suction interface 180 draws fluid 16 toward the outlet orifice 132 and generates the low-restriction return path 130 that provides the continuous flow 154 of fluid 16 through the accessory fluid path 30 and to the outlet orifice 132. This promotes the continuous and regular flow of fluid 16 through the thermistor flow path 50 to account for the consistent and real time measurements of the fluid 16 within the fluid pump 12, as described herein.

The suction interface 180 also promotes the excess flow 56 of the fluid 16 into the inlet orifice 128 and into the accessory fluid path 30. In addition, the suction 24 generated at the inlet 20 also prevents the excess flow 56 of fluid 16 that enters into the outlet orifice 132 from returning to the inlet orifice 128 and the accessory fluid path 30. This configuration of the suction interface 180 and the positioning of the inlet orifice 128 and the outlet orifice 132 at opposite sides of the pump element 120, prevents the recirculation of the excess flow 56 of fluid 16 through the accessory fluid path 30. Such a recirculation may result in an undesirable buildup of heat within the excess flow 56 of fluid 16. This undesirable buildup of heat could result in the readings of the thermistor 14 being inaccurate. The configuration of the inlet orifice 128 and the suction interface 180 prevents this recirculation of the excess flow 56 from occurring.

Referring again to FIGS. 1-16, use of the various aspects of the pump element 120 are configured to provide for movement of fluid 16 through a plurality of flow paths within the fluid pump 12. These plurality of flow paths comprise at least the primary fluid path 110 and the accessory fluid path 30, as described herein. Each of these flow paths are typically configured to move the fluid 16 to the outlet 22 for the fluid pump 12.

Referring again to FIGS. 9-16, the fluid pump 12 includes the pump element 120 that is in communication with the fluid path 26, where the pump element 120 includes the rotor 40 and the stator 42 that are positioned within the housing 64. The inlet orifice 128 is in communication with a pump element 120. The pump element 120 and the inlet orifice 128 direct a primary flow 54 of fluid 16 to the outlet 22 and an excess flow 56 of fluid 16 into the accessory fluid path 30. A portion of the accessory fluid path 30 extends between the rotor 40 and the outer wall 124 of the housing 64, and typically between the rotor 40 and the stator 42. The circuit board housing assembly 10 includes the contoured portion 134 that aligns with and is directed toward one side 66 of the outer wall 124. The accessory fluid path 30 includes the low-restriction return path 130 that moves the excess flow 56 of the fluid 16 as a continuous flow 154 through the accessory fluid path 30 and toward the outlet orifice 132.

In addition, the low-restriction return path 130 is configured to maintain a temperature of the excess flow 56 of fluid 16 within the contoured portion 134 of the accessory fluid path 30 to be similar to a temperature of the primary flow 54 of the fluid 16 within the primary fluid path 110. The thermistor 14 is positioned in communication with a contoured portion 134 to simultaneously monitor, in real time, the temperature of the excess flow 56 of the fluid 16 in the accessory fluid path 30 as well as the temperature of the primary flow 54 of the fluid 16 in the primary fluid path 110. As discussed herein, the temperature of the fluid 16 within these two separate locations is substantially similar due to the direct and continuous flow 154 of fluid 16 from the inlet 20 and to the contoured portion 134 that defines the thermistor flow path 50. Through this configuration, the pump element 120 generates the inward pressure 24 of the inlet 20 of the fluid path 26 as well as at the outlet orifice 132 of the accessory fluid path 30. The pump element 120 also generates an outward pressure 28 at the outlet 22 of the fluid path 26. Using the inward suction 24 generated by the pump element 120, the primary flow 54 of fluid 16 is moved though the primary fluid path 110 of the pump element 120, and the excess flow 56 of fluid 16 is drawn through the accessory fluid path 30 through the interaction of the outlet orifice 132 and the pump element 120 that forms the suction interface 180 of the accessory fluid path 30.

According to the various aspects of the device, as exemplified in FIGS. 1-16, the pump element 120 includes the stator 42 and rotor 40 that are in electromagnetic communication with one another. The stator 42 and rotor 40 are disposed within the housing 64 for the fluid pump 12. The pump element 120 is attached to the first end 150 of a drive shaft 46 of the rotor 40. The inlet orifice 128 is in communication with a pump element 120 and diverts the primary flow 54 of fluid 16 to an outlet 22, via the primary fluid path 110. In addition, the inlet orifice 128 directs the excess flow 56 of fluid 16 through the inlet orifice 128 and into the accessory fluid path 30. The outlet orifice 132 is in communication with a pump element 120. The outlet orifice 132 directs the excess fluid 16 from the accessory fluid path 30 and into the primary fluid path 110 for movement to the outlet 22. The circuit board housing assembly 10 is positioned at the second end 152 of the drive shaft 46 that opposes the first end 150. The circuit board housing assembly 10 includes a contoured portion 134 that is directed toward and aligns with one side 66 of the outer wall 124 of the housing 64. The accessory fluid path 30 directs the excess flow 56 of fluid 16 along a linear path directly from the inlet orifice 128 and to the contoured portion 134 positioned at the opposite side of the motor cavity 114 and the drive shaft 46.

The accessory fluid path 30 includes a low-restriction return path 130 that moves the excess flow 56 of fluid 16, as a continuous flow 154, through the accessory fluid path 30 and toward the outlet orifice 132. The low-restriction return path 130 is configured to maintain the temperature of the excess flow 56 of fluid 16 within the contoured portion 134 of the accessory fluid path 30 to be similar to a temperature of a primary flow 54 of the fluid 16 within the primary fluid path 110 in the pump element 120. The thermistor 14 is positioned in communication with the contoured portion 134 to monitor the temperature of the excess flow 56 of fluid 16 in the thermistor flow path 50 defined by the contoured portion 134. As a result, the thermistor 14 also simultaneously monitors, in real time, the temperature of the primary flow 54 of the fluid 16 in the primary fluid path 110. This is done through the use of a single thermistor 14 that is in communication with the contoured portion 134. Through this configuration, the thermistor 14 can be positioned in close proximity to the PCB 112 within the circuit board housing assembly 10.

Referring again to FIGS. 1-6 and 8-17, having described various aspects of the device, a method 600 is disclosed for operating a fluid pump 12 that utilizes an aspect of the thermistor flow path 50. According to the method 600, a step 602 includes operating a pump element 120 to suction a fluid 16 into a fluid path 26. Step 604 of the method 600 includes dividing the fluid 16 at an inlet orifice 128 between a primary flow 54 of the fluid through the pump element 120 and an excess flow 56 of fluid 16. When the excess flow 56 of fluid 16 is divided away from the primary flow 54 of the fluid 16, the primary flow 54 of the fluid 16 is directed toward the outlet 22 via the primary fluid path 110 (step 606) and the excess flow 56 of fluid 16 is directed toward the accessory fluid path 30 (step 608). As discussed herein, the accessory fluid path 30 includes the low-restriction return path 130 that moves excess flow 56 of the fluid 16 as a continuous flow 154 through the accessory fluid path 30 and toward the outlet orifice 132. As part of the process for directing the excess flow 56 of fluid 16 through the accessory fluid path 30, the excess flow 56 of fluid 16 is moved from the inlet orifice 128 and directly toward a contoured portion 134 of the circuit board housing assembly 10 (step 610). The fluid temperature of the excess flow 56 of fluid 16 is measured within the contoured portion 134 of the accessory fluid path 30 (step 612). According to the method 600, the excess flow 56 of fluid 16 from the contoured portion 134 is then directed toward one of the inlet 20 of the fluid path 26 and the outlet 22 of the fluid path 26 (step 614).

As discussed herein, the various aspects of the device, as exemplified in FIGS. 1-17, are used to expediently deliver an excess flow 56 of fluid 16 through the accessory fluid path 30 to quickly take a temperature measurement of this fluid 16. This temperature measurement is used to also measure, in real time, the temperature of the primary flow 54 of fluid 16 moving through the pump element 120 for the fluid pump 12. This configuration allows the thermistor 14 and other controls for the fluid pump 12 to be all located within the PCB 112 that is located within the circuit board housing assembly 10. Accordingly, need for additional electrical components to be run through the fluid pump 12 is substantially minimized or eliminated. In addition, by locating the controls, the electrical components and electromagnetic components within the PCB 112 and the circuit board housing assembly 10, assembly of the fluid pump 12 is configured to be an efficient process that allows for convenient attachment of the circuit board housing assembly 10 having the PCB 112 to the remainder of the fluid pump 12. In addition, maintenance and repair of the fluid pump 12 is also made easier by allowing various components to be separated and quickly and conveniently replaced as needed over the life of the fluid pump 12. This configuration also allows for the convenient and efficient selection of a circuit board housing assembly 10 having a PCB 112 that includes a PCB 112 and controller components. Accordingly, a wide range of circuit board housing assemblies 10 having various models and types of PCBs 112 can be assembled in an interchangeable and selectable fashion. Through this configuration, assembly of any one of various fluid pumps 12 can be accomplished from a kit of selectable parts that can be attached to one another to provide a customizable solution for generating a wide range of fluid pump solutions.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A fluid pump comprising:

a pump element in communication with an inlet and an outlet of a housing, wherein rotation of the pump element generates an inward suction at the inlet and outward pressure at the outlet that cooperatively moves a fluid through a fluid path;

a stator disposed within the housing and that operates a rotor that is attached to the pump element;

an accessory fluid path in communication with the fluid path and the outlet, wherein an inlet orifice directs a portion of the fluid through the accessory fluid path; and a circuit board housing having a contoured portion that aligns with one side of an outer wall for the housing, the circuit board housing having a printed circuit board (PCB) with a thermistor in communication with the contoured portion of the circuit board housing and the accessory fluid path, wherein:

a low-restriction return path of the accessory fluid path is positioned between the contoured portion and an outlet orifice of the pump element and provides a continuous flow of the fluid that is directed between the contoured portion and the outlet orifice and between the rotor and the outer wall;

the low-restriction return path is configured to maintain a temperature of the continuous flow of the fluid within the contoured portion of the accessory fluid path to be similar to a temperature of the fluid in the fluid path.

2. The fluid pump of claim 1, wherein the thermistor is positioned in communication with the contoured portion to simultaneously monitor, in real time, the temperature of the continuous flow of the fluid in the accessory fluid path and the temperature of the fluid in the fluid path.

3. The fluid pump of claim 1, wherein the inlet orifice directs a portion of the fluid from the inlet to a central channel of the pump element, wherein the central channel extends through a drive shaft of the rotor.

4. The fluid pump of claim 3, wherein the central channel of the drive shaft extends from the inlet orifice and to the contoured portion of the circuit board housing.

5. The fluid pump of claim 1, wherein the outlet orifice is aligned with a diverting portion of the inlet orifice.

6. The fluid pump of claim 5, wherein the diverting portion of the inlet orifice diverts a portion of the fluid into the accessory fluid path before reaching the pump element.

7. The fluid pump of claim 1, wherein the outlet orifice and the pump element receive an excess flow of the fluid from the accessory fluid path and directs the excess flow of the fluid to the outlet through the fluid path.

8. The fluid pump of claim 1, wherein operation of the pump element moves the fluid through a plurality of flow paths, wherein the plurality of flow paths comprise the fluid path and the accessory fluid path.

9. The fluid pump of claim 8, wherein the plurality of flow paths each move the fluid to the outlet.

10. The fluid pump of claim 1, wherein the thermistor is disposed within the contoured portion of the circuit board housing.

11. The fluid pump of claim 1, wherein the inlet orifice and the outlet orifice are each positioned proximate the pump element, and wherein the outlet orifice and the pump element regulates a flow of the fluid into the fluid path and regulates the flow of the fluid into the accessory fluid path.

12. The fluid pump of claim 1, wherein the pump element is a positive displacement pump.

13. A fluid pump comprising:

a pump element in communication with a fluid path, the pump element attached to a rotor that is driven by a stator disposed within a housing; and an inlet orifice in communication with the pump element, wherein the pump element and the inlet orifice direct a primary flow of a fluid to an outlet and an excess flow of the fluid into an accessory fluid path;

a circuit board housing having a contoured portion; and a thermistor is positioned in communication with the contoured portion to simultaneously monitor, in real time, a temperature of the excess flow of the fluid in the accessory fluid path and the temperature of the fluid in the fluid path; wherein the accessory fluid path includes a low-restriction return path that moves the excess flow of the fluid as a continuous flow through the accessory fluid path and toward an outlet orifice;

a portion of the accessory fluid path extends between the rotor and an outer wall of the housing; and the low-restriction return path is configured to maintain the temperature of the excess flow of the fluid in the contoured portion of the accessory fluid path to be similar to a temperature of the primary flow of the fluid.

14. The fluid pump of claim 13, wherein the inlet orifice directs a portion of the fluid from an inlet to a central channel of the pump element, wherein the central channel extends through a drive shaft of the rotor to the contoured portion of the circuit board housing.

15. The fluid pump of claim 14, wherein the outlet orifice is aligned with a diverting portion of the inlet orifice that diverts a portion of the fluid into the accessory fluid path before reaching the pump element.

16. The fluid pump of claim 13, wherein the outlet orifice and the pump element receive accessory fluid from the accessory fluid path and direct the accessory fluid to the outlet through the fluid path.

17. The fluid pump of claim 13, wherein the pump element generates an inward suction at an inlet of the fluid path and at the outlet orifice of the accessory fluid path, and wherein the pump element generates an outward pressure at the outlet of the fluid path.

18. A fluid pump comprising:

A stator and a rotor in electromagnetic communication and disposed within a housing;

a pump element attached to a first end of a drive shaft of the rotor; and an inlet orifice in communication with the pump element that diverts a primary flow of a fluid to an outlet and an excess flow of the fluid into an accessory fluid path;

an outlet orifice in communication with the pump element, the outlet orifice directing excess fluid from the accessory fluid path to a primary fluid path connected with the outlet;

a circuit board housing positioned at a second end of the drive shaft that opposes the first end and includes a contoured portion that defines a section of the accessory fluid path; and a thermistor positioned in communication with the contoured portion the contoured portion directing the excess flow of the fluid into communication with the thermistor; wherein the accessory fluid path directs the excess flow of the fluid along a linear path directly from the inlet orifice to the contoured portion;

the accessory fluid path includes a low-restriction return path that moves the excess flow of the fluid as a continuous flow through the accessory fluid path and toward the outlet orifice;

the low-restriction return path is configured to maintain a temperature of the excess flow of the fluid in the contoured portion of the accessory fluid path to be similar to a temperature of the primary flow of the fluid; and the thermistor simultaneously monitors, in real time, the temperature of the excess flow of the fluid in the accessory fluid path and the temperature of the primary flow of the fluid in the primary fluid path.

19. The fluid pump of claim 18, wherein the outlet orifice is aligned with a diverting portion of the inlet orifice that diverts the excess flow of the fluid into the accessory fluid path before reaching the pump element, and wherein the outlet orifice and the pump element receive accessory fluid from the accessory fluid path and direct the accessory fluid to the outlet through the primary fluid path.

20. The fluid pump of claim 18, wherein the pump element generates an inward pressure at an inlet of the primary fluid path and at the outlet orifice of the accessory fluid path, and wherein the pump element generates an outward pressure at the outlet of the primary fluid path.

* * * * *